US007093833B1

(12) United States Patent
Horning

(10) Patent No.: US 7,093,833 B1
(45) Date of Patent: Aug. 22, 2006

(54) CASINO CARD GAME

(76) Inventor: Troy D. Horning, R.R.#2 Box 428, Richfield, PA (US) 17086

( * ) Notice: Subject to any disclaimer, the term of this patent is extended or adjusted under 35 U.S.C. 154(b) by 372 days.

(21) Appl. No.: 10/707,077

(22) Filed: Nov. 19, 2003

(51) Int. Cl.
*A63F 1/00* (2006.01)

(52) U.S. Cl. ..... 273/274; 273/292

(58) Field of Classification Search ..... 273/292, 273/274, 309; 463/12, 13
See application file for complete search history.

(56) References Cited

U.S. PATENT DOCUMENTS 5,566,946 A * 10/1996 Parker ..... 273/292
2004/0066000 A1* 4/2004 Webb ..... 273/292
2005/0082755 A1* 4/2005 Snow ..... 273/273

* cited by examiner

*Primary Examiner*—William M. Pierce
(74) *Attorney, Agent, or Firm*—John J. Elnitski, Jr.

(57) ABSTRACT

A method of playing a card game. The object of the card game is that each player must achieve a preset minimum point value with a hand of three cards and beat the hand of a dealer. To achieve the minimum point value, the cards of the hand are added together and must be of the same suit. The exception to the rule is that all three (3) of a kind hands can be counted for points and always equals the point value of thirty and one-half (30½) points. In the card game, a hand of an Ace, King and Queen of the same suit equals a point value of thirty-one (31).

21 Claims, 2 Drawing Sheets

CASINO CARD GAME

BACKGROUND OF INVENTION

The present invention generally relates to card games which can be played using cards or electronic simulation of cards. More specifically, the present invention relates to a casino type card game with a jackpot.

The increase in casinos has given rise for new card games to attract gamers into the casinos. The gamers desire card games which are new, fast paced, fun and easy to play. The gamers also desire card games which can be played in an electronic form. Therefore, casinos always welcome new card games to attract gamers which can be played OLE_LINK1using cards or electronic simulation of cards.

It is an object of the present invention to provide a new casino card game.

SUMMARY OF INVENTION

A method of playing a card game. The object of the card game is that each player must achieve a preset minimum point value with a hand of three cards and beat the hand of a dealer. To achieve the minimum point value, the cards of the hand are added together and must be of the same suit. The exception to the rule is that all three (3) of a kind hands can be counted for points and always equals the point value of thirty and one-half (30½) points. In the card game, a hand of an Ace, King and Queen of the same suit equals a point value of thirty-one (31).

DETAILED DESCRIPTION

Figure 1:
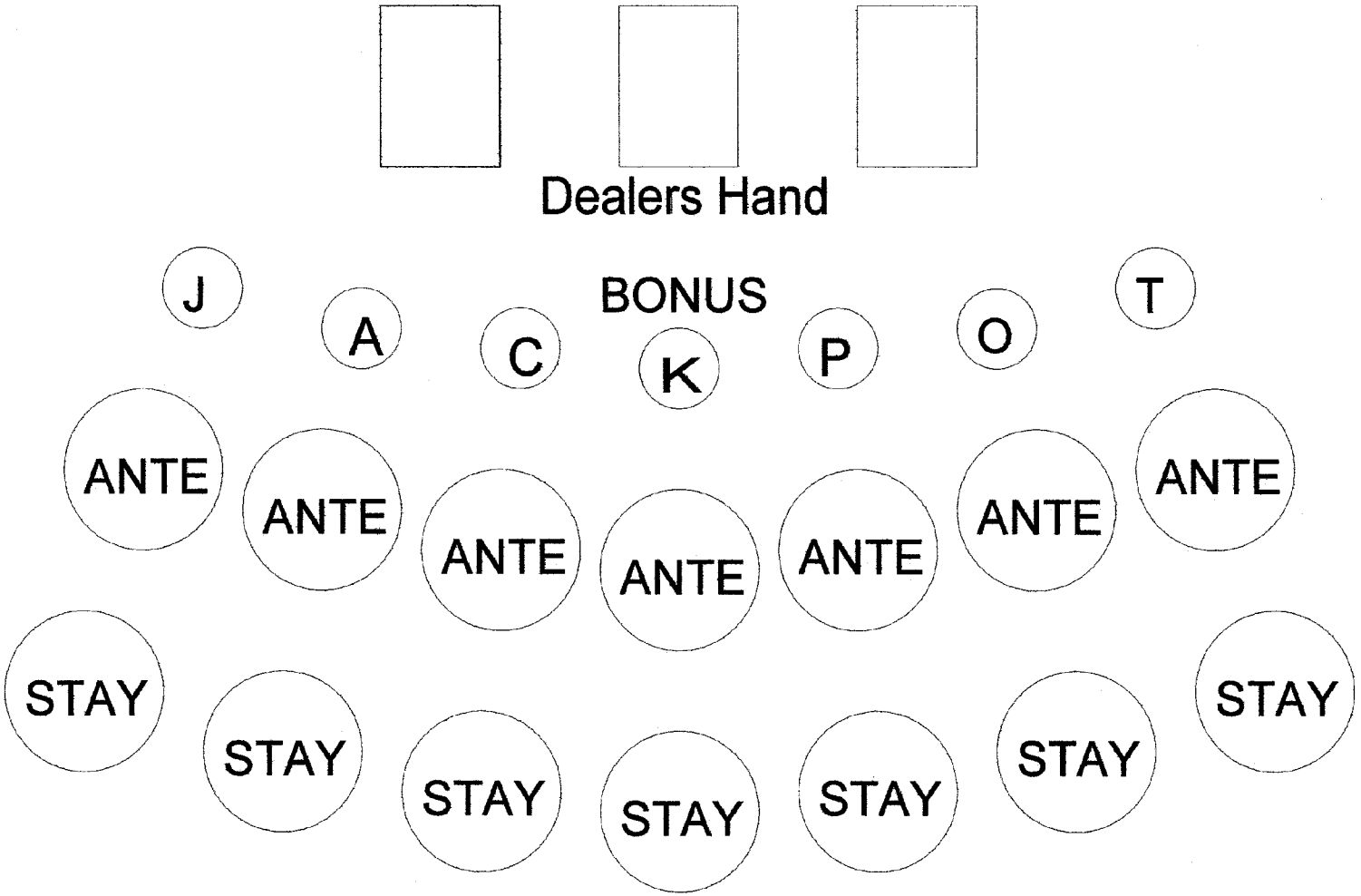
FIG. 1 is a schematic view of casino table layout according to the present invention.

The present invention is a method of playing a card game. The card game can be played using cards or electronic simulation of cards. The card game employs one standard fifty-two (52) deck of cards. The cards have a ranking point value as follows: Aces=11 points, Kings, Queens, Jacks and Tens each=10 points, and Twos through Nines=the numerical value displayed on the card. FIG. 1 shows a possible casino table layout to play the card game using cards. The casino table layout has an ante circle labeled for each player to place an initial bet in the ante labeled circle. The casino table layout has stay circle labeled spots for each player to place an additional bet in the stay labeled circle, if the player wishes to continue playing a hand. The casino table layout has bonus circle labeled spots for each player to place a bonus bet in the bonus labeled circle, if the player wishes to bet a bonus bet. The casino table layout has three (3) rectangular spots for the dealer to place the dealer cards. The object of the card game is that each player must achieve a preset minimum point value with a hand of three cards and beat the hand of a dealer. To achieve the minimum point value, the cards added to together must be of the same suit.

Figure 2:
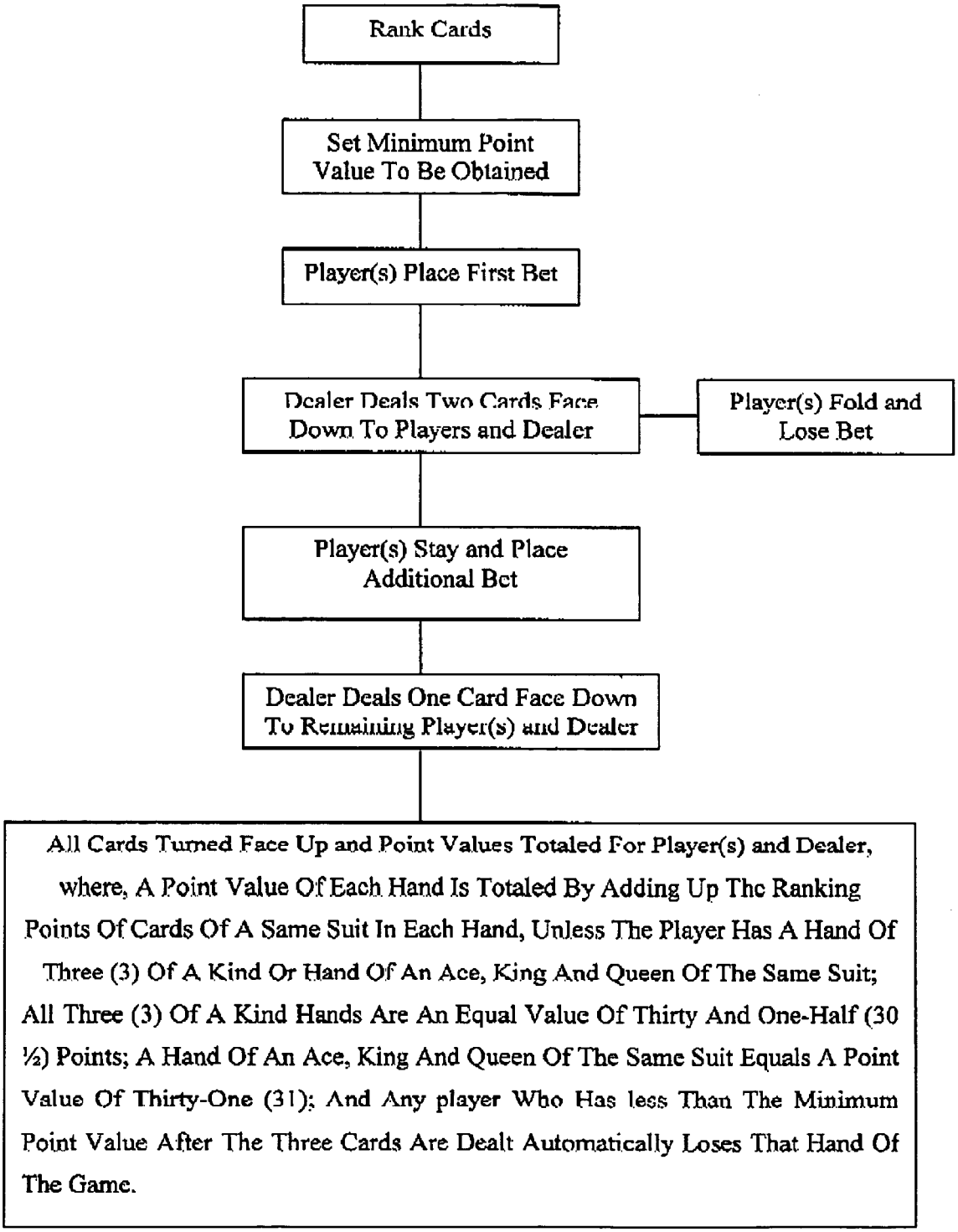
FIG. 2 is a flow chart of a casino card game according to the present invention.

A minimum point value must be set at the beginning of the card game. A typical minimum point value is sixteen (16), and is the value which will be used as an example. A player who has less than the minimum point value after the three cards are dealt automatically loses that hand of the game. Therefore, using the above example, any player with fifteen (15) points or less automatically loses. In the card game, all three (3) of a kind hands are an equal value of thirty and one-half (30½) points. In the card game, a hand of an Ace, King and Queen of the same suit equals a point value of thirty-one (31). All ties, over the minimum point value, between the player and the dealer are a push, whereby the player does not lose the money in the ante and stay circles. There can be a bonus jackpot in the card game, by placing a bonus bet at the beginning of the hand and obtaining a hand of an Ace, King and Queen of the same suit. FIG. 2 shows a flow chart on how the card game can be played.

The play of the game is as follows. The player or players place a bet on the ante circle and, if so desired, place a bonus bet. The dealer deals two cards face down to all players and then to the dealer. Next, each player decides to stay or fold. If a player folds, the player who folds loses the bet place in the ante circle. If the player stays the player must match the ante bet with an equal bet amount. Then, the dealer deals one card face down to all remaining players and to the dealer. Finally, all cards of the remaining players are turned face up and point values for each player and dealer are individually totaled to decide the winner or winners. If a bonus bet is placed by a player and the player does not get a hand of an Ace, King and Queen of the same suit, that player loses the money place in the bonus bet. As state above, the rules and play of the above-described card game can be incorporated into any electronic form, such as a hand held game or computer game.

The card game can be played without a dealer or without betting by simply eliminating either the dealer or betting or both. Suggested odds for the game with a sixteen point minimum are as follows. A King, Queen and Jack of the same suit are 25 to 1. An Ace and any two cards equaling a value of twenty are 10 to 1. Any three of a kind hands are 5 to 1. Three card hands totaling thirty are 4 to 1. Hands totaling twenty-six to twenty-nine are 3 to 1. Hands totaling twenty-one to twenty-five are 2 to 1. Hands totaling sixteen to twenty are 1 to 1.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

The invention claimed is:

1. A method of playing a card game, comprising:

ranking cards to have point values such that Aces equal 11 points, Kings, Queens, Jacks and Tens each equal 10 points, and Twos through Nines equal the numerical value displayed on the card;

setting a minimum point value to be obtained by each player and a dealer of the card game;

all players playing a hand of the card game place a first bet, whereby there is at least one player and a dealer;

the dealer deals two cards face down of a three card hand to all players and to the dealer;

each player reviews the player's own hand two cards and decides to stay or fold, if a player decides to fold, the player exits the hand and loses the what the player bet and if a player stays, the player must place an additional bet to stay;

the dealer deals one card face down to all remaining players who have chosen to stay and to the dealer; and all cards of the remaining players are turned face up and point values for each player and dealer are totaled individually to decide a winner, whereby to total point values for each remaining hands and decide the winner, the following is applied:

point value of each hand is totaled by adding up the ranking points of cards of a same suit in each hand, unless the player has a hand of three (3) of a kind or hand of an Ace, King and Queen of the same suit;

all three (3) of a kind hands are an equal value of thirty and one-half (30½) points;

a hand of an Ace, King and Queen of the same suit equals a point value of thirty-one (31); and any player who has less than the minimum point value after the three cards are dealt automatically loses that hand of the game.

2. The method of claim 1, wherein all ties when the point values of the hands are totaled, over the minimum point value, between the player and the dealer are a push.

3. The method of claim 1, wherein there is a bonus jackpot in the card game which can be won by placing a bonus bet at the beginning of the hand and obtaining a hand of an Ace, King and Queen of the same suit.

4. The method of claim 1, wherein the set minimum point value is sixteen (16).

5. The method of claim 1, wherein a casino table layout is used to play the card game; wherein the casino table layout has an ante circle labeled for each player to place an initial bet in the ante labeled circle; wherein the casino table layout has stay circle labeled spots for each player to place an additional bet in the stay labeled circle; wherein the casino table layout has bonus circle labeled spots for each player to place a bonus bet in the bonus labeled circle; and wherein the casino table layout has three (3) rectangular spots for the dealer to place the dealer cards.

6. The method of claim 1, wherein all ties when the point values of the hands are totaled, over the minimum point value, between the player and the dealer are a push and wherein the set minimum point value is sixteen (16).

7. The method of claim 1, wherein there is a bonus jackpot in the card game which can be won by placing a bonus bet at the beginning of the hand and obtaining a hand of an Ace, King and Queen of the same suit and wherein the set minimum point value is sixteen (16).

8. The method of claim 1, wherein all ties when the point values of the hands are totaled, over the minimum point value, between the player and the dealer are a push; wherein there is a bonus jackpot in the card game which can be won by placing a bonus bet at the beginning of the hand and obtaining a hand of an Ace, King and Queen of the same suit; and wherein the set minimum point value is sixteen (16).

9. The method of claim 2, wherein a casino table layout is used to play the card game; wherein the casino table layout has an ante circle labeled for each player to place an initial bet in the ante labeled circle; wherein the casino table layout has stay circle labeled spots for each player to place an additional bet in the stay labeled circle; wherein the casino table layout has bonus circle labeled spots for each player to place a bonus bet in the bonus labeled circle; and wherein the casino table layout has three (3) rectangular spots for the dealer to place the dealer cards.

10. The method of claim 3, wherein a casino table layout is used to play the card game; wherein the casino table layout has an ante circle labeled for each player to place an initial bet in the ante labeled circle; wherein the casino table layout has stay circle labeled spots for each player to place an additional bet in the stay labeled circle; wherein the casino table layout has bonus circle labeled spots for each player to place a bonus bet in the bonus labeled circle; and wherein the casino table layout has three (3) rectangular spots for the dealer to place the dealer cards.

11. The method of claim 5, wherein a casino table layout is used to play the card game; wherein the casino table layout has an ante circle labeled for each player to place an initial bet in the ante labeled circle; wherein the casino table layout has stay circle labeled spots for each player to place an additional bet in the stay labeled circle; wherein the casino table layout has bonus circle labeled spots for each player to place a bonus bet in the bonus labeled circle; and wherein the casino table layout has three (3) rectangular spots for the dealer to place the dealer cards.

12. The method of claim 6, wherein a casino table layout is used to play the card game, wherein the casino table layout has an ante circle labeled for each player to place an initial bet in the ante labeled circle; wherein the casino table layout has stay circle labeled spots for each player to place an additional bet in the stay labeled circle; wherein the casino table layout has bonus circle labeled spots for each player to place a bonus bet in the bonus labeled circle; and wherein the casino table layout has three (3) rectangular spots for the dealer to place the dealer cards.

13. The method of claim 7, wherein a casino table layout is used to play the card game; wherein the casino table layout has an ante circle labeled for each player to place an initial bet in the ante labeled circle; wherein the casino table layout has stay circle labeled spots for each player to place an additional bet in the stay labeled circle; wherein the casino table layout has bonus circle labeled spots for each player to place a bonus bet in the bonus labeled circle; and wherein the casino table layout has three (3) rectangular spots for the dealer to place the dealer cards.

14. The method of claim 8, wherein a casino table layout is used to play the card game; wherein the casino table layout has an ante circle labeled for each player to place an initial bet in the ante labeled circle; wherein the casino table layout has stay circle labeled spots for each player to place an additional bet in the stay labeled circle; wherein the casino table layout has bonus circle labeled spots for each player to place a bonus bet in the bonus labeled circle; and wherein the casino table layout has three (3) rectangular spots for the dealer to place the dealer cards.

15. The method of claim 1, wherein the method is played in an electronic form.

16. A method of playing a card game, comprising:

ranking cards to have point values such that Aces equal 11 points, Kings, Queens, Jacks and Tens each equal 10 points, and Twos through Nines equal the numerical value displayed on the card;

setting a minimum point value to be obtained by each player of the card game;

dealing three cards to all players; and all cards of the players are totaled to determine a individual point value for each player to decide a winner, whereby to total point values for each player and decide the winner the following is applied:

point value of a hand is totaled by adding up the ranking points of cards of a same suit in each hand, unless the player has a hand of three (3) of a kind or hand of an Ace, King and Queen of the same suit;

all three (3) of a kind hands are an equal value of thirty and one-half (30½) points;

a hand of an Ace, King and Queen of the same suit equals a point value of thirty-one (31); and any player who has less than the minimum point value after the three cards are dealt automatically loses that hand of the game.

17. The method of claim 16, wherein the set minimum point value is sixteen (16).

18. The method of claim 16, wherein the method is played in an electronic form.

19. A method of playing a card game, comprising:

ranking cards to have point values such that Aces equal 11 points, Kings, Queens, Jacks and Tens each equal 10 points, and Twos through Nines equal the numerical value displayed on the card;

setting a minimum point value to be obtained by each player of the card game;

all players playing a band of the card game place a first bet;

dealing two cards face down of a three card hand to all players;

each player reviews the player's own hand two cards and decides to stay or fold, if a player decides to fold, the player exits the hand and loses the what the player bet and if a player stays, the player must place an additional bet to stay;

dealing one card face down to all remaining players who have chosen to stay; and all cards of the remaining players are turned face up and point values for each player are totaled individually to decide a winner, whereby to total point values for each remaining hands and decide the winner, the following is applied:

point value of each band is totaled by adding up the ranking points of cards of a same suit in each hand, unless the player has a hand of three (3) of a kind or hand of an Ace, King and Queen of the same suit;

all three (3) of a kind hands are an equal value of thirty and one-half (30½) points;

a hand of an Ace, King and Queen of the same suit equals a point value of thirty-one (31); and any player who has less than the minimum point value after the three cards are dealt automatically loses that band of the game.

20. The method of claim 19, wherein there is a bonus jackpot in the card game which can be won by placing a bonus bet at the beginning of the hand and obtaining a hand of an Ace, King and Queen of the same suit.

21. The method of claim 1, wherein the set minimum point value is sixteen (16).

* * * * *